United States Patent [19]

Schnoor

[11] Patent Number: 4,789,247

[45] Date of Patent: Dec. 6, 1988

[54] BLANKET CONVERTIBLE TO A TOTE BAG

[76] Inventor: Halina Schnoor, 37465 Green Dr., Eastlake, Ohio 44094

[21] Appl. No.: 56,221

[22] Filed: Jun. 1, 1987

[51] Int. Cl.[4] ..... A47C 17/82; B31B 19/26; B31B 49/04

[52] U.S. Cl. ..... 383/4; 383/76; 190/2; 5/417; 493/225; 493/254; 493/267

[58] Field of Search ..... 383/4, 76; 190/1, 2; 2/69.5, 89; 5/417–419; 150/52 R; 493/225, 254, 916, 928, 267

[56] References Cited

U.S. PATENT DOCUMENTS

| | | | |
|---|---|---|---|
| 1,479,903 | 1/1924 | Erland | 383/4 X |
| 2,183,418 | 12/1939 | Williams | 2/69.5 X |
| 2,395,794 | 2/1946 | Foster | 150/52 R |
| 2,451,142 | 10/1948 | Zimmern | 383/4 X |
| 2,479,203 | 8/1949 | Brown | 383/4 |
| 2,791,775 | 5/1957 | Sartell | 2/69.5 |
| 2,898,609 | 8/1959 | Storie | 5/419 |
| 3,967,668 | 7/1976 | Franco | 150/52 R |
| 3,976,113 | 8/1976 | Kim | 383/4 |
| 4,600,091 | 7/1986 | McLeod | 190/2 |
| 4,606,070 | 8/1986 | Schachter | 383/4 |

FOREIGN PATENT DOCUMENTS

| | | | |
|---|---|---|---|
| 1407484 | 9/1975 | United Kingdom | 190/2 |

*Primary Examiner*—William Price
*Assistant Examiner*—Sue A. Weaver

[57] ABSTRACT

A convertible beach blanket may be easily converted into a tote bag having a number of internal compartments by folding in a first then a second direction and pulling on a cord confined to a portion of the blanket by a series of eyelets formed in a circular configuration.

7 Claims, 2 Drawing Sheets

BLANKET CONVERTIBLE TO A TOTE BAG

BACKGROUND OF THE INVENTION

1. Field of the Invention

The present invention generally relates to blankets formable into tote bags and particularly to blankets which are converted into such tote bags by folding and drawing together a string of the blanket.

2. Description of the Prior Art

Blankets which convert into tote bags are known. These blankets depended on zippers and/or "Velcro" fasteners on one side of the blanket to form the blanket into a tote bag. These type of fasteners do not wear well in the sandy environment of the beach where such blankets are usually used. Also, they require a plurality of zippers which individually formed individual corners of the tote bag and making it difficult to convert the blanket to a tote bag and vice versa. Some examples of such known blankets may be found in U.S. Pat. Nos. 3,976,113 and 3,818,962.

Thus what was needed was a convertible blanket and tote bag which was durable and resistant to the sandy environment of a beach and was easily converted from a blanket to a tote bag.

SUMMARY OF THE INVENTION

The present invention solves the problems associated with prior art devices and others by providing a blanket which is easily converted to a multi-compartment tote bag by folding the blanket and pulling on a drawstring sinusoidally extending through a series of apertures extending through the blanket.

To accomplish this the blanket has a pillow compartment mounted to one end of the blanket. The same end of the blanket has a series of eyelets forming an oval pattern on the blanket. A cord or rope is strung through these eyelets to form a sinusoidal pattern with the rope appearing on both sides of thw lower or upper half of the blanket.

To convert the blanket to a tote bag the blanket is folded in half lengthwise with the pillow case located inside or outside the folds. The blanket is then folded again in half with the rope appearing on both external sides of the folds. The rope is then tightened to corrugate the sides of the blanket with two separate compartments formed therebetween due to the double fold and having the pillow case compartment located inside or outside one of these compartments to provide another pocket compartment.

Thus it will be seen that one aspect of the present invention is to provide a convertible blanket which easily converts into a multi-compartment tote bag.

Yet another aspect fo the present invention is to provide a convertible blanket which converts into a tote bag by folding and pulling on opposite ends of a cord alternately extending through the blanket in a series of oval forming eyelets.

These and other aspects of the present invention will be more fully understood after a review of the description of the preferred embodiment when considered with the drawings.

DESCRIPTION OF THE PREFERRED EMBODIMENT

Figure 1:
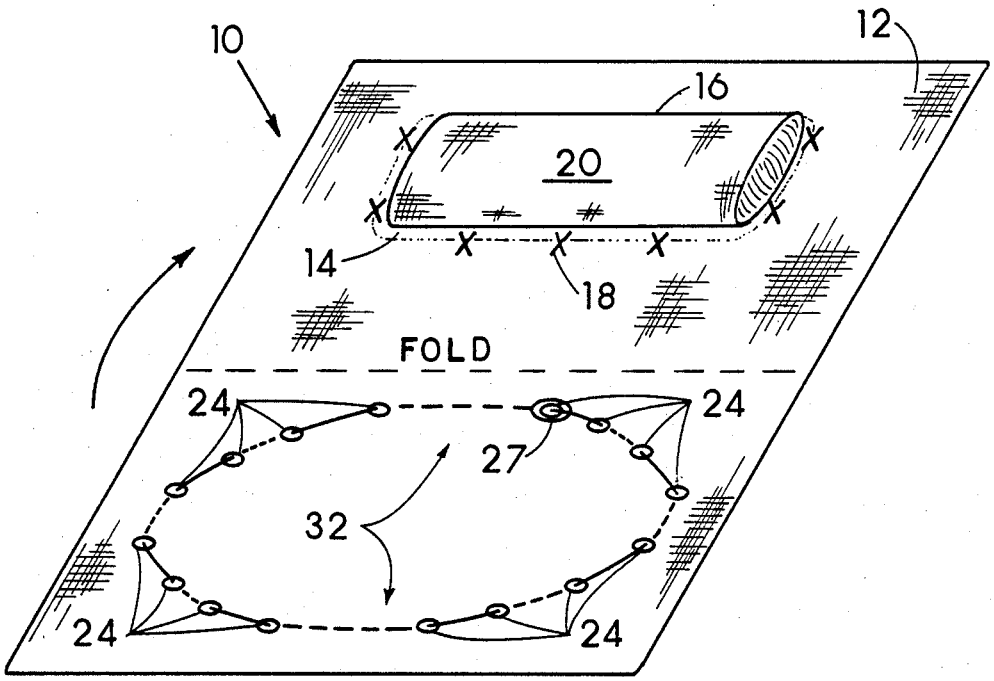
FIG. 1 is an isometric view of the blanket of the present invention as it would be for use on a beach or recreational spot.

Referring now to the drawings where the showings are intended to describe a preferred embodiment of the invention without limiting the invention thereto, FIG. 1 shows a convertible beach blanket assembly 10 having a first side 12 intended for reclining on by one or two people. The first side 12 has a pillow holder assembly 14 affixed on the top half of the blanket assembly 10 near the top of the blanket assembly 10.

Figure 5:
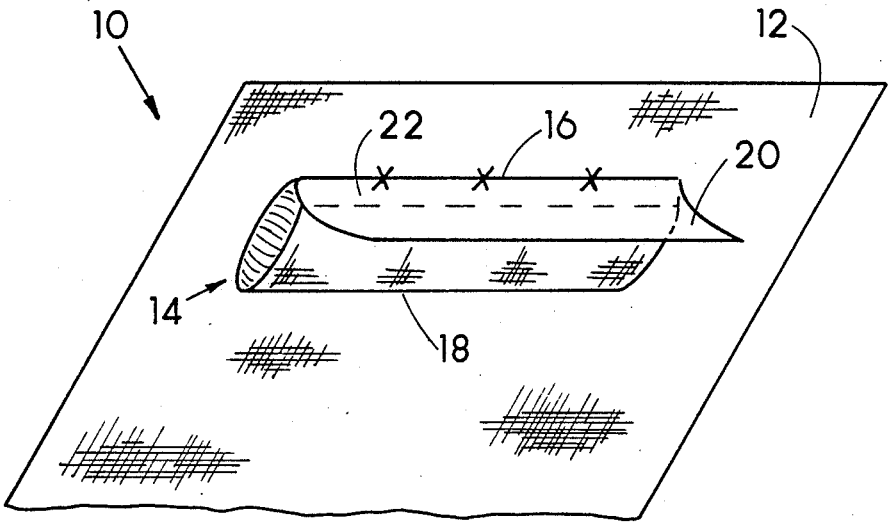
FIG. 5 is an expanded view of the pillow case of the FIG. 1 blanket opened to accept the pillow or other storage material.

The pillow holder assembly 14 is attached to the blanket assembly 10 along one end 16 by sewing through points 18. Other attachment means may also be used such as buttons, zippers, "Velcro" and the like. A flap 20 of the assembly 14 may be rotated around the line 16, as seen in FIG. 5 to expose a pocket 22 into which a pillow, towel and valuables such as watches and jewelry may be inserted. The flap 20 secures the material stored inside the pocket 22 by either being inserted into the pocket 22 or being fastened to the line 16 by attachment means such as buttons, zippers, "Velcro", and the like. In any event, once the pocket 22 is filled the flap 20 seals the pocket 22 and the assembly 14 is restored to its position as shown in FIG. 1, hiding the fact that the assembly 14 may have a pocket 22 containing any valuables. Two compartments on either a blanket or a pillow case could be created by sewing a pocket on both sides of the blanket and allowing a control flap to cover one leaving the other open.

The lower or upper half of the blanket assembly 10 has a series of eyelets 24 extending through the first side 12 and a second side 26 of the blanket assembly 10 to form a roughly circular pattern thereof. Each of the eyelets 24 is an aperture having a metal reinforcing ring 27 which is exemplified in FIG. 2 but appears on all the eyelets 24, or a sewed reinforced buttonhole which prevents a cord or rope 30 threaded through the eyelets 24 from tearing the blanket assembly 10. Parts of the cord or rope 30 thus appear on both sides 12 and 26 of the blanket assembly because of the sinusoidal threading of the cord or rope 30 through the eyelets 24. Thus the cord or rope 30 is shown in combined dotted and solid line on the Figures. Along the middle of the circular pattern formed by the eyelets 24 appears a larger space between the eyelets 24. This space and the rope 30 extending therethrough form a handle assembly 32 which will be explained later.

Turning now to FIGS. 1 through 4 it will be seen how the beach blanket assembly may be easily converted to a tote bag.

Figure 2:
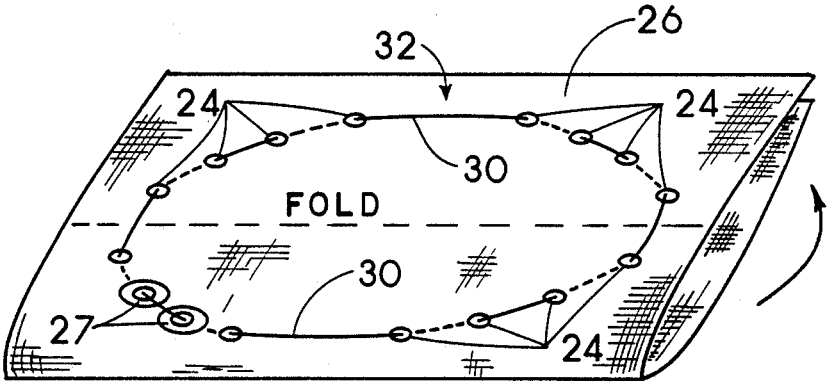
FIG. 2 is a view of the FIG. 1 blanket folded in half.

The blanket assembly is first folded along the dotted FOLD line of FIG. 1 in a clockwise direction until the bottom edges of the blanket assembly 10 line up with the top edges of the blanket assembly 10 with the pillow assembly trapped therebetween as seen in FIG. 2. The direction of the fold could also be counter-clockwise to make the pillow assembly fall on the outside of the tote bag. The FOLD line is an imaginary line extending along the width of the blanket assembly 10 approximately halfway down the length of the blanket assembly. For ease of convertability this dotted line along with the FOLD label could be printed on the first side of the blanket assembly 10.

Figure 3:
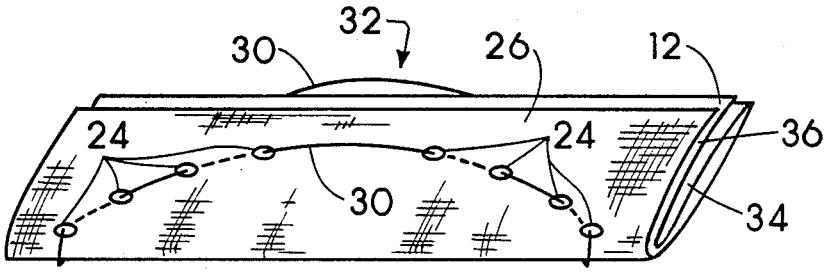
FIG. 3 is a view of the FIG. 2 folded blanket folded again in half.

The blanket assembly as seen in FIG. 2 is then again folded along the imaginary dotted line indicating FOLD, which could also be actual, but now in a counterclockwise direction to have the bottom and top edges meet as is best seen in FIG. 3. Note that this provides the cord 30 on both external sides of the FIG. 3 assembly with two separate internal compartments 34 and 36 formed between the external surfaces. In addition, the pillow assembly 14 is attached to the side 12 of the compartment 36 and forms yet a third internal compartment.

Figure 4:
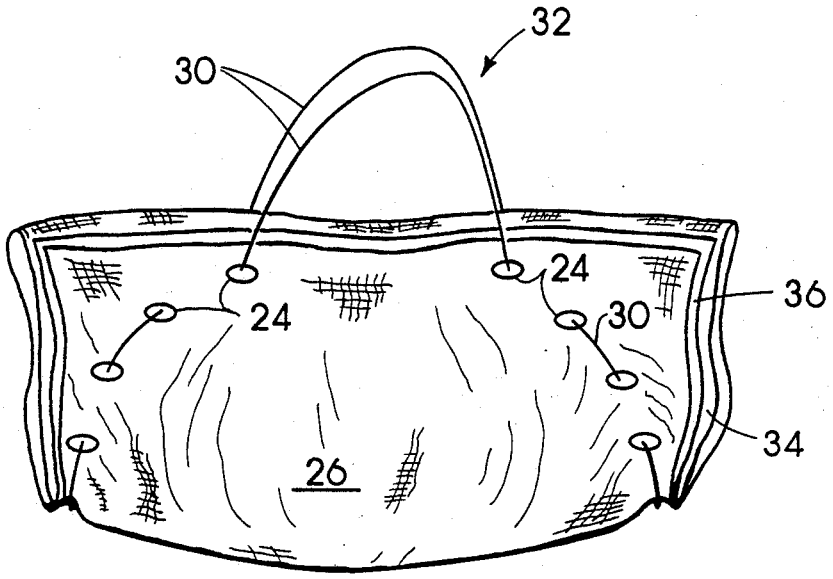
FIG. 4 is a side view of the FIG. 3 blanket after the rope is pulled to form the tote bag.

Next, the handle assembly 32 is pulled up by simultaneously grasping the cord 30 at both ends and pulling up. This forces the eyelets 24 on both sides of the handle assembly 32 to squeeze together thereby corrugating the sides of the blanket assembly 10 and preventing anything trapped in the internal compartments 34 and 36 from falling out the sides. The converted blanket as a tote bag is shown in FIG. 4.

It will be understood that certain modifications and improvements have been deleted herein for the sake of conciseness and readability. One example would be to the blanket assembly fold into a single compartment by a single fold. This would require the eyelets to be formed along the perimeter of the blanket rather than on only one half. Another would be to have the pillow case formed on the same portion of the blanket as the eyelets to thereby appear on the external surface of the converted tote bag rather than internally. A third would be to have the bag formed from a pillow case rather than a blanket to accomodate a recliner or lounge chair. Clearly all such modifications and improvements are considered as equivalents on the present invention as claimed.

What is claimed is:

1. A convertible blanket tote bag assembly comprising:

a blanket having a generally rectangular top and bottom surface;

a series of spaced eyelets extending through the top and bottom surface of said blanket to form a circle-like pattern on said blanket;

a cord being threaded through each of said eyelets from one adjoining eyelet to the other to form a circle-like loop; and said spaced eyelets being formed on only one half of the length of said blanket to allow the converting of said blanket into a tote bag upon folding the blanket half without eyelets unto the eyelet containing half.

2. A convertible blanket as set forth in claim 1 wherein said spaced eyelets have a larger space between eyelets in the middle of said blanket to thereby allow said cord to form a handle.

3. A convertible blanket as set forth in claim 1 including a pillow case assembly mounted toward one end.

4. A convertible blanket as set forth in claim 3, wherein said pillow case assembly is mounted to the blanket and has a sealing section which is exposed when the blanket is unfolded and covered when the blanket is folded.

5. A convertible blanket as set forth in claim 4 wherein said pillow case assembly is mounted at the top of the blanket opposite said spaced eyelet half of the blanket.

6. A method of converting a beach blanket having a series of eyelets with a cord threaded therethrough to form an oval pattern into a tote bag comprising the steps of:

forming the eyelets along one half of the periphery of the blanket;

folding the blanket a first time along the middle to have the eyelet half of the blanket cover the other half having no eyelets; and pulling opposite ends of the cord located along the middle of the blanket and the end of the blanket to corrugate the ends thereof and form a tote bag thereby.

7. A method as set forth in claim 6 including the steps of:

folding the blanket a second time after the first time along the middle but in a direction opposite the first fold to provide a tote bag having a pair of internal compartments when the cord is pulled together to from a tote bag.

* * * * *